United States Patent [19]

Martin et al.

[11] Patent Number: 4,497,194

[45] Date of Patent: Feb. 5, 1985

[54] METHOD AND APPARATUS FOR PERFORMING MULTIPLE CLOSED AND SEMI-CLOSED OPERATIONS ON AN OPEN DIE PRESS

[75] Inventors: Wayne A. Martin, Wilkins Township, Allegheny County; Justin G. Modic, Richland Township, Allegheny County, both of Pa.

[73] Assignee: United States Steel Corporation, Pittsburgh, Pa.

[21] Appl. No.: 387,999

[22] Filed: Jun. 14, 1982

[51] Int. Cl.[3] ..... B21D 22/00

[52] U.S. Cl. ..... 72/356; 72/477; 72/421

[58] Field of Search ..... 72/477, 421, 482, 356; 83/552

[56] References Cited

U.S. PATENT DOCUMENTS

| | | | |
|---|---|---|---|
| 2,394,700 | 2/1946 | Jongedyk . | |
| 2,747,270 | 5/1956 | Crawford | 72/356 |
| 2,932,338 | 4/1960 | Franch | 72/356 |
| 3,056,197 | 10/1962 | Lawson | 72/356 |
| 3,160,046 | 12/1964 | Bredon | 83/552 |
| 3,359,774 | 12/1967 | Bouchard et al. . | |
| 3,478,563 | 11/1969 | Bozek . | |
| 3,815,402 | 6/1974 | Durar | 72/356 |
| 3,831,426 | 8/1974 | Hakner . | |
| 3,839,935 | 10/1974 | Daniels | 83/552 |
| 3,949,635 | 4/1976 | Daniels | 83/552 |
| 3,965,716 | 6/1976 | Suzuki | 72/356 |
| 4,286,454 | 9/1981 | Bachmann | 72/356 |
| 4,287,748 | 9/1981 | Wolfthal . | |
| 4,364,256 | 12/1982 | Gorlaschi | 72/356 |

OTHER PUBLICATIONS

Advertising Brochure of Beaumont Well Works Company Houston, Tex.-pp. 12 and 13.

*Primary Examiner*—Leon Gilden

*Attorney, Agent, or Firm*—William F. Riesmeyer, III

[57] ABSTRACT

An apparatus is provided for performing multiple operations on a conventional open-die forge press, and includes a rotatable top punch assembly and stationary bottom die assembly. The top punch assembly includes a mounting fixture secured to the press crosshead, a holder plate rotatably mounted on the fixture, a plurality of punches extending downwardly from the holder plate, and motor means for indexing the punches sequentially into forging position over the bottom die assembly. A method is also provided for making valve pots, including upsetting a heated metal block in a split die and punching a hole through the block, the improvement in which during the upsetting step a vertically reciprocable member is extended so as to close a bottom opening in the split die, in order that the split die will function as a closed die, and during the punching step the reciprocable member is retracted so as to allow a punch-core to fall through said opening. This permits faster production rates since less handling of the dies is required.

5 Claims, 3 Drawing Figures

METHOD AND APPARATUS FOR PERFORMING MULTIPLE CLOSED AND SEMI-CLOSED OPERATIONS ON AN OPEN DIE PRESS

BACKGROUND OF THE INVENTION

The present invention relates to a method and apparatus for performing multiple operations in one heat on a forge press, particularly to a method of making valve pots and apparatus for performing multiple closed and semi-closed operations on a conventional open-die press.

In the conventional method of making products similar to valve pots, a heated metal block is placed in a split die held in an outer circumferential die retainer. The metal workpiece is then upset so as to fill the cavity in the split die. A hole is then punched partially through the workpiece. Subsequently, the die, retainer and workpiece are lifted and set upon a shear ring having a hole mateable with a hole in the bottom of the split die. Then a hole is punched completely through the workpiece and the metal core drops into the hole in the shear ring. After these operations, the die, retainer and workpiece are turned upside down. Then the retainer is lifted off the die, permitting separation of the split die sections and finally removal of the workpiece from the die. It will be apparent that this operation is time-consuming and requires a relatively large number of steps, particularly for handling the die and retainer.

It is the primary object of this invention to significantly decrease the time required for production of valve pots, by decreasing the number of steps involved and the amount of handling required.

It is another object of this invention to provide apparatus for performing multiple closed and semi-closed operations on a conventional open die press.

SUMMARY OF THE INVENTION

According to the present invention, an apparatus is provided for performing multiple operations on a forge press. The apparatus includes a top punch assembly having a fixture adapted to be secured on the underside of the press crosshead. A horizontally elongated punch holder plate is rotatably mounted about a vertical axis of said holder plate on said fixture. A plurality of punches extend downwardly from said holder plate at spaced positions along the periphery of a circle, the center of which is at the axis of rotation of the holder plate. Motor means is provided for axial rotation of the holder plate to position the punches sequentially over a stationary bottom die set. Preferably, the apparatus includes means for locking the holder plate in position when each of the punches are properly aligned over the bottom die set. Also, the bottom die assembly may include a split die, a die retainer for holding the split die, and means for locking the split die in the retainer. Finally, the apparatus may include a bottom upset member reciprocable in a vertical direction for selectively closing a bottom opening in the split die.

A method is also provided for making valve pots in which during upsetting of the workpiece in a split die, a vertically reciprocable upset member is extended so as to close an opening in the bottom of the split die, enabling the split die to function as a closed or semi-closed die, and during the subsequent punching step, the upset member is retracted so as to permit passage of a punch core from the workpiece through the bottom of the split die.

DESCRIPTION OF THE PREFERRED EMBODIMENT

Figure 1:
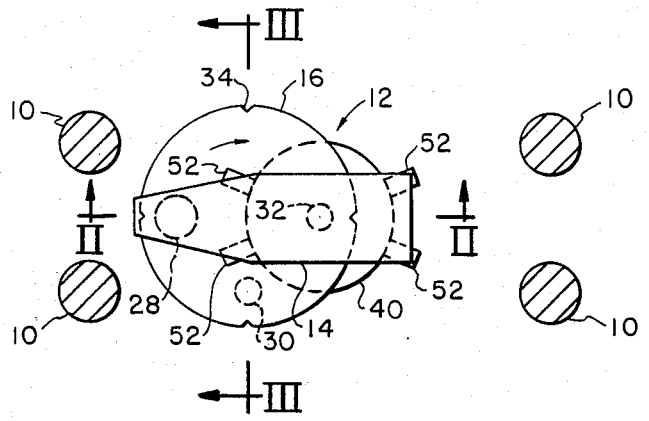
FIG. 1 is a schematic plan view of the apparatus of this invention.
Figure 2:
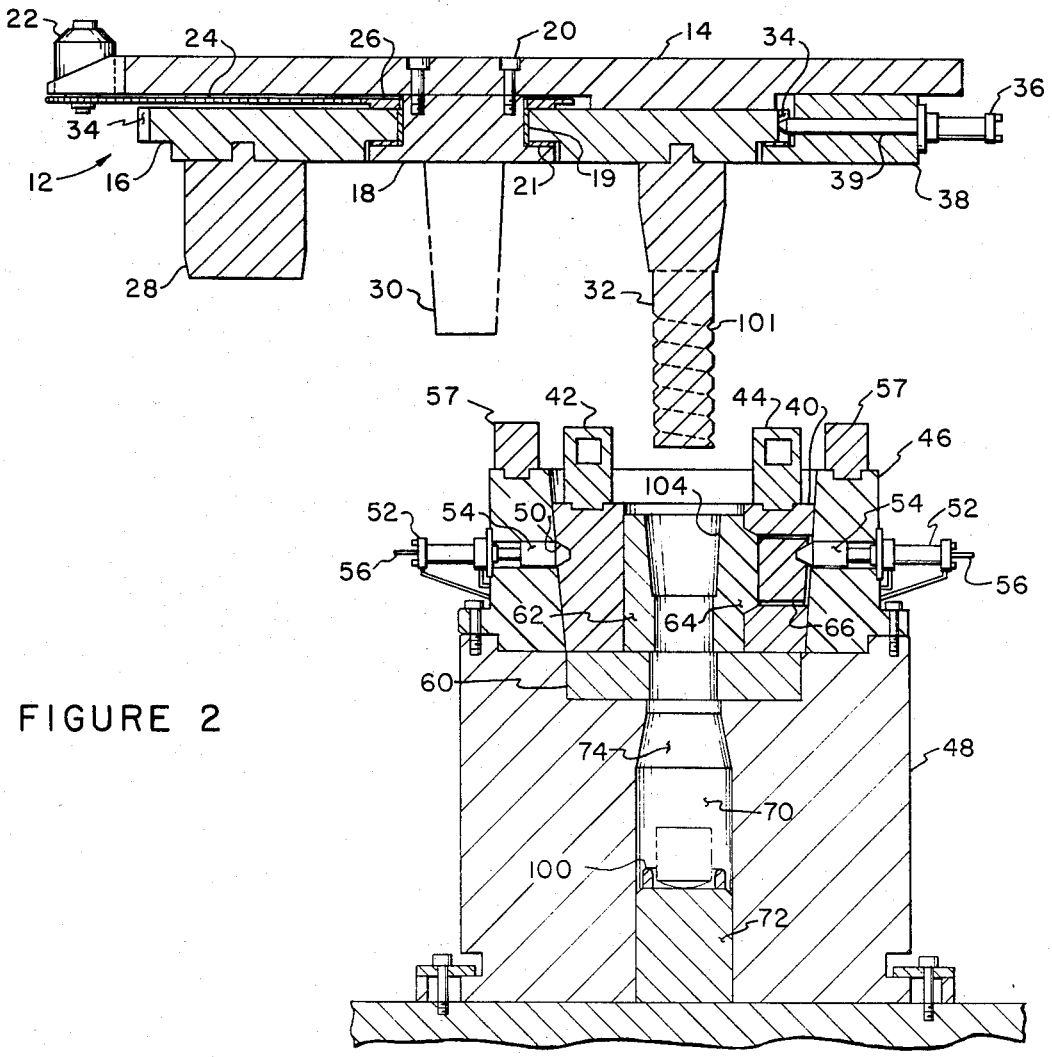
FIG. 2 is a section taken at II—II of FIG. 1.

Referring to FIGS. 1 and 2, the conventional open-die forge press includes four (4) vertical columns 10 (FIG. 1) on which a vertically reciprocable rectangular crosshead (not shown) is mounted. An example of a conventional press is shown in U.S. Pat. No. 3,638,471, the specification of which is incorporated by reference herein. The apparatus of this invention includes a top punch assembly 12 having a generally rectangular fixture plate 14 secured to the underside of the crosshead by bolts (not shown). A circular punch holder plate 16 is rotatably mounted on bearing block 18 which is secured to the fixture by studs 20. A bronze bushing 19 is provided between the rotating surfaces of the bearing and holder plate. It is bolted to the stationary bearing. Similarly, bronze liners 21 are provided on the horizontal surface, also bolted to the stationary bearing. Fittings (not shown) are provided for lubrication of the bushing and liner. A hydraulic motor 22 drives chain 24 mounted on sprocket 26 which is secured to the holder plate. A plurality of punches 28, 30, 32 depend downwardly from the holder plate at spaced locations. The holder plate has v-notches 34, or receptacles (FIGS. 1 and 2), adjacent each of the punch locations. A fluid powered cylinder 36 mounted in a support 38 secured to the fixture drives pin 39 into the v-notches of the holder plate to lock it in position so that each punch is properly located with respect to the bottom die. The taper on the end of pin 39 will contact the surface of each v-notch should they be slightly mis-aligned and move the holder plate into precise alignment as required. We use a sight mark on the fixture (not shown) adjacent the hydraulic motor for rough alignment of the holder plate by the person operating the press. Support 38 also serves to support the punches along with bearing block 18 when the punches are being retracted from the workpiece.

The bottom die assembly includes a split die 40 which comprises two mateable semi-circular segments. The split die has two lifting lugs 42, 44, each mounted on opposite of the die segments and which are engageable by the prongs of a manipulator or other lifting means. A die retainer 46 is secured to a bottom riser 48. The retainer and split die have mateable upwardly tapered surfaces which enable the split die to be lifted easily out of the retainer. The split die has an outer annular groove 50. Four (4) fluid powered cylinders 52 (FIGS. 1 and 2) are mounted on the retainer. Each have a pin 54 connected to the piston rod which is reciprocable into and out of groove 50 for selectively locking the split die in the retainer and to hold the die down during stripping or retracting of the punches as hereafter described. Each cylinder is located 22 degrees off the longitudinal center-line between the press columns (FIG. 1) so as to permit clearance for the punches used in our particular arrangement. We use double-acting cylinders having rod 56 extending outwardly from the back of the cylinder. This rod serves as a sight pin to give positive indication of the location of pin 54, i.e., as to whether or not it is engaged or disengaged from groove 50. Gage control blocks 57 mounted on the top of the retainer serve as stops for the top punches when the punches have penetrated to the correct depth. However, when punch 28 is used for upsetting the block, we control the degree of deformation by pressure readings on the press to insure that the proper deformation is obtained. Blocks 57 are slightly higher than lifting lugs 42, 44 to prevent applying pressure on the lugs when the punches are lowered into working position.

Figure 3:
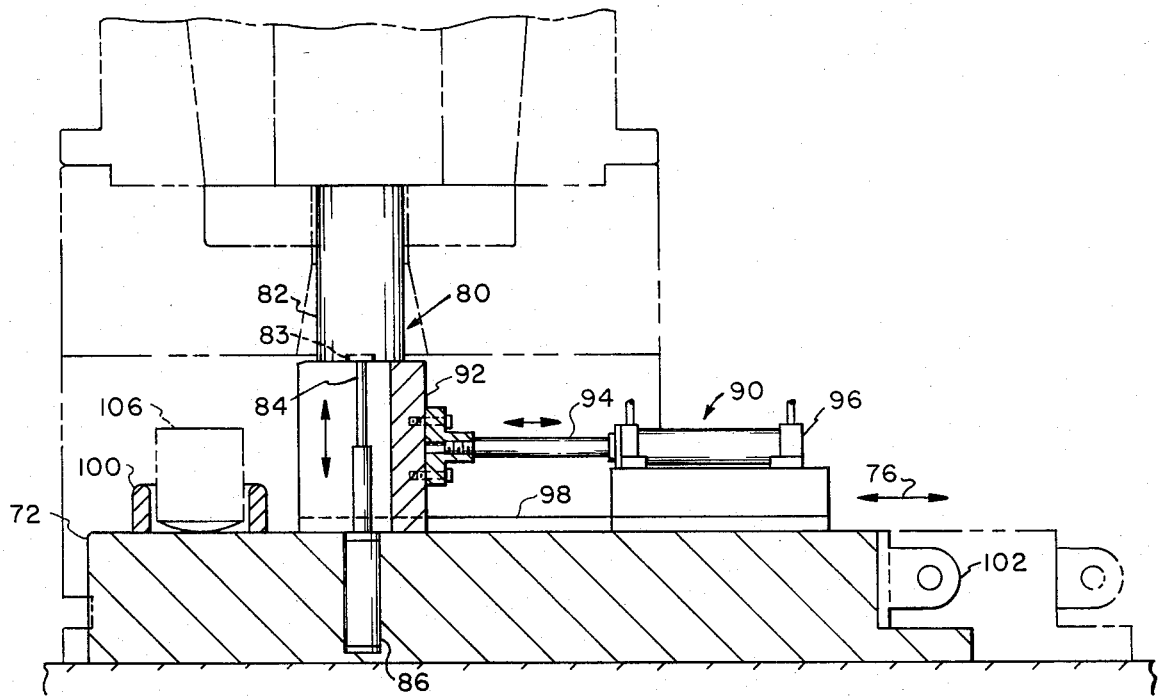
FIG. 3 is a partial section taken at III—III of FIG. 1.

The bottom die riser 48 has space for removable disc insert 60 which forms and supports the bottom face of the workpiece 62. It will be apparent that various inserts may be used to provide tapered or other bottom surface configurations. In the present illustration, the workpiece is a pump valve pot which has a longitudinal central cavity and a side boss 64. Gas relief vent-holes 66 are provided in the split die in the area of side boss 64 so as to permit complete filling of this area during upsetting. A cavity 70 extends lengthwise through the bottom riser providing space for slidable base 72 having an upset member assembly and support assembly associated therewith as is presently to be described. Central tapered hole 74 in the riser is mateable with openings in the die insert 60 and split die 40. Referring to FIG. 3, base 72 is movable back and forth in horizontal directions indicated by arrows 76. A bottom upset assembly 80 includes fluid powered cylinder 86 having a telescoping piston rod 84 and upset pin 82. Pin 82 has a counterbore 83 in its bottom surface. Rod 84 engages the counterbore of pin 82 for raising it into the upper position as shown closing the bottom opening in the split die insert. Then, since rod 84 is not permanently attached to pin 82, the rod can then be lowered after the support block 92 is moved into position underneath pin 82 as hereafter described. Support assembly 90 includes U-shaped support block 92 connected to reciprocable rod 94 of fluid powered cylinder 96. A pair of spaced parallel guide-rails, one of which is shown at 98, guide back and forth horizontal movement of support block 92. Cradle 100 is provided for receiving a punch-core or center plug punched from the workpiece when base 72 is moved to the position to the right of FIG. 3. It will be apparent the base can be moved by a press pusher or separate hydraulic cylinder connected to eyelet 102 on the base.

In operation, the apparatus is used as follows for making valve pots: a heated metal, forged or rolled round, is placed in the cavity of the split die. Upset pin 82 is raised so as to close off the opening in the bottom of the split die. Support block 92 is moved to a position beneath the upset pin. The rod 84 of cylinder 86 is retracted so as to prevent excessive pressure on it during forging. Punch 28 is rotated into position over the split die and locked into position by extension of pin 39 into the v-notch in the holder plate adjacent punch 28. The crosshead of the press is then lowered driving punch 28 into the metal workpiece, upsetting it to substantially fill out the cavity and form the side boss in the split die. Rod 84 of cylinder 86 is again raised so as to engage the upset pin. Support block 92 is moved to the right in FIG. 3 and upset pin 82 is then retracted to its lowered position. Pin 39 is retracted and punch 30 is rotated into position over the split die, after which pin 39 is again extended to lock the punch in position. The crosshead is again lowered so as to drive punch 30 into the workpiece forming the tapered cavity control 104. Punch 30 is of predetermined length so that when gage control blocks 57 are engaged by the holder plate, cavity 104 will be of the exact depth prescribed in the valve pot being made. We have found that retraction of the upset pin for this step, although not required, makes withdrawal of punch 30 from the workpiece much easier. Finally, pin 39 is retracted and punch 32 is rotated into forging position. Punch 32 has spiral cooling grooves 101. Base 72 is moved to the right in FIG. 3 so as to position cradle 100 beneath the opening in the split die. Punch 32 is then pushed into the workpiece so as to pierce a hole completely therethrough. Punch core 106 then falls into cradle 100 on the base 72. Thus, the apparatus permits a number of upset and punching steps to be performed in rapid succession without the usual steps required for handling of the dies and workpiece. The apparatus is especially suitable for manufacture of valve pots by a method which significantly improves the rate of production.

We claim:

1. An apparatus for performing multiple operations on an open die press, said apparatus comprising:

a top punch assembly which includes a mounting fixture adapted to be secured on the underside of a crosshead of said press, a horizontally elongated punch holder plate rotatably mounted about a vertical axis thereof on the underside of said fixture, a plurality of punches extending downwardly from said holder plate at spaced locations along the periphery of a circle, the center of which is located at the axis of rotation of said holder plate, and motor means connected to said holder plate for the axial rotation thereof, and a bottom die assembly adapted to be mounted in stationary position under said crosshead of the press, for receiving respective of said punches as the crosshead is lowered, said punches being sequentially indexable into forging position with respect to said die assembly, said bottom die assembly including a split die having a generally vertical cavity extending therethrough, said split die having a bottom surface for supporting a workpiece placed in said die and an opening in communication with the cavity in said die, said bottom riser including a bottom upset member assembly, said assembly including a base, a member mounted on said base for closing the bottom opening of said cavity in said split die, and means on said base for selectively raising said member in a vertical direction to a stationary upper position for closing the bottom opening in said split die during an upset operation, and lowering said member, exposing the opening in said die during a punching operation.

2. The apparatus of claim 1 further comprising means on said fixture selectively engageable with said holder plate for locking each of the punches in proper forging position and supporting the punches as they are removed from the workpiece, said holder plate having spaced receptacles for receipt of said locking means therein.

3. The apparatus of claim 1 wherein said split die includes means on the top surface thereof for enabling said split die to be grasped and lifted out of said retainer.

4. The apparatus of claim 1 wherein said bottom upset member assembly further includes a support assembly mounted on said base for absorbing forces exerted downwardly on said upset member during an upset operation, said support assembly including a support block having a vertical dimension essentially equal to the space between the bottom of said upset member when extended and the top surface of said base, and means for selectively moving said support bar in a horizontal direction into and out of position for support of said upset member.

5. The apparatus of claim 4 wherein said base is slidably movable within said bottom riser in a horizontal direction to altenate positions, said base having a cradle adjacent said upset member assembly for receiving a punch core of the workpiece when in one of said positions.

* * * * *